US007873288B2

(12) United States Patent
Taubenberger et al.

(10) Patent No.: US 7,873,288 B2
(45) Date of Patent: Jan. 18, 2011

(54) SYSTEM AND METHOD FOR DETECTING A FIRE IN A FIXER UNIT OF A PRINTER OR COPIER

(75) Inventors: Hans Taubenberger, Gmund (DE); Roland Wolf, Unterhaching (DE); Kurt Zietlow, Grafing (DE)

(73) Assignee: Oce Printing Systems GmbH, Poing (DE)

( * ) Notice: Subject to any disclaimer, the term of this patent is extended or adjusted under 35 U.S.C. 154(b) by 142 days.

(21) Appl. No.: 12/374,407

(22) PCT Filed: Aug. 1, 2007

(86) PCT No.: PCT/EP2007/057976

§ 371 (c)(1),
(2), (4) Date: Jan. 20, 2009

(87) PCT Pub. No.: WO2008/015243

PCT Pub. Date: Feb. 7, 2008

(65) Prior Publication Data

US 2009/0310987 A1 Dec. 17, 2009

(30) Foreign Application Priority Data

Aug. 1, 2006 (DE) ..... 10 2006 035 829

(51) Int. Cl.
*G03G 15/20* (2006.01)

(52) U.S. Cl. ..... 399/33

(58) Field of Classification Search ..... 399/33, 399/122, 67

See application file for complete search history.

(56) References Cited

U.S. PATENT DOCUMENTS

| | | | | |
|---|---|---|---|---|
| 3,731,743 | A * | 5/1973 | Marshall | 169/91 |
| 3,753,466 | A | 8/1973 | Uematsu | |
| 6,449,458 | B1 | 9/2002 | Lang et al. | |
| 7,085,510 | B2 | 8/2006 | Rosenstock | |
| 2004/0033457 | A1 * | 2/2004 | Zhang et al. | 431/79 |
| 2004/0228643 | A1 | 11/2004 | Behnke et al. | |
| 2005/0042004 | A1 | 2/2005 | Segerer et al. | |

FOREIGN PATENT DOCUMENTS

| | | |
|---|---|---|
| DE | 2 148 901 | 4/1972 |
| DE | 198 27 210 | 12/1999 |
| DE | 102 15 353 | 10/2003 |
| DE | 103 05 775 | 9/2004 |

(Continued)

*Primary Examiner*—David P Porta
*Assistant Examiner*—Kiho Kim
(74) *Attorney, Agent, or Firm*—Schiff Hardin LLP

(57) ABSTRACT

In a fixer unit system and method to detect a fire in a fixer unit of an electrographic image generation device, at least one portion of a fixer region of the fixing unit is monitored with a photoelectric sensor arranged adjacent to a substrate material having a toner image to be fixed, at least one portion of radiation generated by at least one heat radiator of the fixer unit is not detected by the photoelectric sensor by not passing said at least one portion of the radiation generated by the at least one heat radiator through to the photoelectric sensor by use of an optical filter associated with the photoelectric sensor. An error signal is output when a fire in the fixer region is detected with the photoelectric sensor.

12 Claims, 10 Drawing Sheets

FOREIGN PATENT DOCUMENTS

| | | | |
|---|---|---|---|
| DE | 103 33 106 | | 3/2005 |
| DE | 103 38 516 | | 4/2005 |
| EP | 1 452 930 | | 9/2004 |
| JP | 60133487 | | 7/1985 |
| JP | 06011938 A | * | 1/1994 |

* cited by examiner

SYSTEM AND METHOD FOR DETECTING A FIRE IN A FIXER UNIT OF A PRINTER OR COPIER

BACKGROUND

The preferred embodiment concerns a system and a method to detect a fire in a fixer unit of an electrographic image generation device. It is known to arrange a smoke sensor in a suction channel through which the exhaust is drawn from a fixer space of a fixer unit.

From the document DE 102 15 353 A1 it is known to arrange a sensor arrangement with electrically conductive sensor cables below a substrate material to be fixed, which sensor cables burn through upon meeting a burning portion of the substrate material. In the event of a fire, the current flow through the burned-through sensor part is interrupted and an error signal is generated.

In particular in radiation fixer units with radiation heating elements, a risk of fire exists due to substrate material residues that are exposed to the radiant heat generated by the radiation heating elements. The possibility also exists that, given an unexpected stoppage of the substrate material, the heat power of the radiation heating elements cannot be reduced quickly enough, whereby the substrate material exposed to the radiant heat can be ignited. In particular in high-capacity printers with printing speeds of ≧1 m per second, a high heat power of the radiation fixer unit is required in order to provide the energy required for fixing. Infrared heat radiators below or-between which a substrate material with a toner image to be fixed on the substrate material is directed are advantageously used in the radiation fixer unit. This toner image is fixed on the substrate material via the heat radiated by the heat radiators. The infrared heat radiators thereby generate a temperature of multiple 100° C. Stopped paper in the region of the heat radiators ignites in the shortest time, i.e. within a few seconds.

In order to be able to better control the heat power of the heat radiators and to protect the substrate material to be fixed from the unwanted heat radiation, the heat radiator can be temporarily covered with a blind arrangement. Such a blind arrangement is known from the documents DE 198 27 210 C1 and DE 103 38 516 B3, for example. The use of a blind is in particular advantageous when a paper web should be printed and toner images located thereupon should be fixed. Upon opening this blind, paper residues located in the radiation region of the heat radiators (which paper residues have remained in the fixer unit after a tear of a paper web to be printed, for example) can be ignited. The fire of the paper residues typically propagates in the fixer unit and spreads to the paper web. The occurrence of a fire in the fixer unit must be detected as quickly as possible in order to be able to take measures via which a propagation of the fire is prevented.

As mentioned above, various sensor arrangements are known to determine a fire in the fixer unit. After the fire detection, the fire area (i.e. the fixer region of the fixer station) can be sealed off. Partitions are advantageously used for this, wherein a first partition is arranged before the fixer unit in the main transport direction of the substrate material and a second partition is arranged after the fixer unit in the main transport direction of the substrate material. Upon detection of a fire in the fixer unit, these partitions are closed, whereby the fire area is hermetically sealed. The burning paper residues as well as the paper web burn at maximum up to these partitions. After a cleaning of the inside of the fixer unit, the printing operation can be continued.

One possibility for fire detection of the fixer unit is to monitor an exhaust air flow (generated from the fixer unit with the aid of a suction device) with the aid of a smoke sensor. A portion of the primary air flow can thereby be diverted and directed via a filter element to the smoke sensor. Its output voltage increases proportional to the particle flow present in the exhaust current monitored by the smoke sensor. If the output voltage exceeds a preset limit value, the sensor detects a fire in the fixer unit and the partitions are closed. Due to the complex current relationships and various possible fire locations, a significant time (in particular multiple seconds) can elapse between the start of a fire and the fire detection, whereby necessary safety reactions are unnecessarily delayed.

Furthermore, it is not possible to differentiate smoke particles from other particles contained in the exhaust flow with the aid of smoke sensors, whereby a fire can also be detected by the smoke sensor when, for example, many particles generated by contaminants are contained in the exhaust due to a significant friction of the substrate material, which particles cloud the exhaust. Faulty activations can thereby occur due to these contaminants. Such contaminants can in particular arise due to paper dust particles, toner particles or due to emissions from offset printing methods. A quick, correct detection of a fire is thus possible only with difficulty in the prior art, wherein faulty activations cannot be safely avoided.

The cited documents are herewith incorporated by reference into the present specification. In particular, the constructive and functional design of the radiation fixer units described in these documents as well as the blind shielding of the radiation fixer units can advantageously be used in connection with the embodiment described in the following.

A device to monitor a region in a fixer unit for smoke development is known from the document DE 2148901 A, in which a single light source serves as a light source for fixing the toner material adhering on a substrate material and as a light source for a sensor arrangement to detect smoke.

An arrangement for certain controlling of a fixer unit during a stoppage of the substrate material is known from the document JP 60133487 A, in which the temperature of the substrate material to be fixed is detected. A conflagration of the substrate material should thereby be prevented.

An automatic fire suppression device for use in an electrophotographic copier in order to extinguish a combustion of a flammable substrate material in the fixer unit is known from the document U.S. Pat. No. 3,753,466 A. Means to detect a fire are thereby provided.

It is an object of the invention to specify a method for detection of a fire in a fixer unit of an electrographic image generation device and a fixer unit with a device to detect a fire, via which a fire can be quickly and accurately detected.

In a fixer unit system and method to detect a fire in a fixer unit of an electrographic image generation device, at least one portion of a fixer region of the fixing unit is monitored with a photoelectric sensor arranged adjacent to a substrate material having a toner image to be fixed, at least one portion of radiation generated by at least one heat radiator of the fixer unit is not detected by the photoelectric sensor by not passing said at least one portion of the radiation generated by the at least one heat radiator through to the photoelectric sensor by use of an optical filter associated with the photoelectric sensor. An error signal is output when a fire in the fixer region is detected with the photoelectric sensor.

DESCRIPTION OF THE PREFERRED EMBODIMENT

Figure 1:
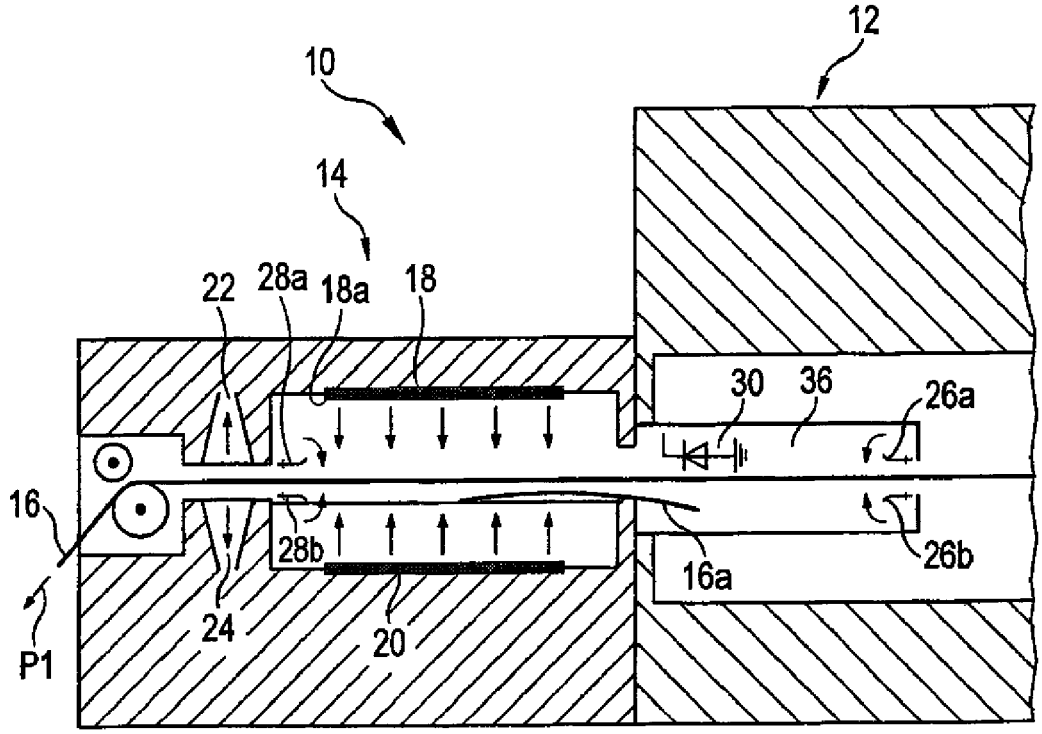
FIG. 1 is a section representation of a side view of a portion of an electrographic high-capacity printer.

For the purposes of promoting an understanding of the principles of the invention, reference will now be made to the preferred embodiment/best mode illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

In a fixer unit for detection of a fire in the fixer unit of an electrographic image generation device, a photoelectric sensor to detect a fire is arranged in the display unit adjacent to a substrate material that possesses a toner image to be fixed. The substrate material advantageously contains at least one toner image that is transfer-printed onto the substrate material and is fixed on this with the aid of the fixer unit. A fire (in particular a flame) can be accurately and reliably detected with the aid of the photoelectric sensor. The breakout of a fire is detected without additional delay via the optical monitoring of at least one part of the inner space of the fixer unit or, respectively, of a fixer region. Techniques to contain the fire can thereby be immediately taken. In particular, partition devices to seal off the fixer region of the fixer unit can be sealed. At least a portion of the radiation emitted by the heat radiators of the fixer unit is not detected by the photoelectric sensor. A portion of the radiation generated by the heat radiators is not passed through to the photoelectric sensor with the aid of an optical filter upstream of the photoelectric sensor. It is thereby ensured that the radiation caused by the fire is registered to detect a fire, and that the result detected by the sensor is not (or is only slightly) affected or adulterated by the radiation emitted by the heat radiators.

The photoelectric sensor can thereby be a photodiode, a phototransistor and/or a solar cell. An optical filter can also be provided that is upstream of the photoelectric sensor and that advantageously passes light in the visible spectral range to the photoelectric sensor. In particular the radiation emitted by the heat radiators of a radiation fixer unit can thereby be filtered out, whereby only radiation of a spectral range that has a characteristic spectral range caused by fire or by flames is passed through the filter to the photoelectric sensor.

The fixer unit advantageously comprises a heat radiator, in particular an infrared heat radiator, that is arranged opposite the front side and/or back side of the substrate material so that a toner image on the front side and/or back side of the substrate material is fixed on the substrate material with the aid of the heat generated by the heat radiator upon directing the substrate material past the heat radiator. An intervening space is advantageously provided between the heat radiator and the substrate material, wherein the at least one photoelectric sensor monitors at least one region of the intervening space.

It is advantageous to provide a monitoring unit to monitor the function of the photoelectric sensor. Such a monitoring unit enables function errors (in particular failures) of the photoelectric sensor to be detected. It can therefore be ensured that the photoelectric sensor outputs an error signal upon occurrence of a combustion or of a fire in the fixer unit. The monitoring unit advantageously has a light source and an evaluation circuit, wherein the light source emits light via which the photoelectric sensor generates an error signal. The evaluation circuit monitors an error signal of the photoelectric sensor that is caused by the light emitted by the light source. If the evaluation circuit thereby determines that the photoelectric sensor outputs no error signal even though the light source is activated so that it emits light, a sensor error is output. The sensor error can cause a stoppage of the printing process and/or a deactivation of the heat radiator.

Via the monitoring of the function of the photoelectric sensor, a first error signal can be output upon occurrence of a sensor error and a second error signal can be output upon occurrence of a conflagration. It is advantageous to continuously monitor the function of the photoelectric sensor during the printing process with the aid of the monitoring unit. The danger of an unnoticed combustion is thereby minimized. Damages (in particular due to the fire encroaching on other regions of the photographic image generation device) can thereby be avoided.

A second aspect of the preferred embodiment concerns a method to detect a conflagration in a fixer unit of an electrophotographic image generation device. In this method at least one part of a fixer region of the fixer unit is monitored with the aid of a photoelectric sensor. At least a portion of the radiation generated by the heat radiators of the fixer unit is not registered with the aid of the photoelectric sensor. An error signal is output when a conflagration in the fixer region is detected with the aid of the photoelectric sensor. The photoelectric sensor is advantageously arranged adjacent to the substrate material to be fixed.

Via such a method, conflagrations can be certainly and promptly detected after their generation, whereby techniques can be taken very quickly in order to prevent a propagation of the conflagration.

The preferred embodiment can advantageously be used in electrographic printing or copying apparatuses whose recording methods for image generation are in particular based on the electrophotographic, magnetographic or ionographic recording principle. The printing or copying apparatuses can also use a recording method for image generation in which an image recording medium is directly or indirectly activated electrically, point-by-point. However, the preferred embodiment is not limited to such electrographic printing or copying apparatuses.

For better comprehension of the present invention, reference is made in the following to the preferred exemplary embodiments presented in the drawings, which preferred exemplary embodiments are described using specific terminology. However, it is noted that the protective scope of the invention should not thereby be limited since such variations and additional modifications to the shown devices and/or the described methods, as well as such further applications of the invention as they are indicated therein, are viewed as typical present or future specialized knowledge of a competent man skilled in the art. Figures show exemplary embodiments of the invention, namely:

A section presentation of the side view of an electrographic high-capacity printer 10 that has at least one printing unit 12 and one fixer unit 14 is shown in FIG. 1. The printing unit 12 advantageously has two printing groups that, in the present exemplary embodiment, print a paper web 16 with a respective print image on its front side and on its back side. For this the printing groups generate at least one toner image on the front side of the paper web 16 and optionally at least one toner image on the back side of the paper web 16. The paper web 16 with the toner images located thereupon is directed through between infrared radiation heating elements 18, 20 of the fixer unit 14 that generate the amount of heat required to fix the toner images on the paper web 16. During the printing and fixing process the paper web 16 printed by the high-capacity printer 10 has a transport speed of typically $\geqq 0.6$ m per second, such that a sufficiently large amount of heat for fixing the toner images must be provided at this speed with the aid of the infrared radiation heating elements 18, 20.

Before the start of the fixing process, the heating elements 18, 20 must be heated to a preset temperature in order to achieve a desired fixing result. During this heating process the paper web 16 is shielded from the heating elements 18, 20 so that no radiant heat or only a small portion of the radiant heat generated by the heating elements 18, 20 strikes the paper web 16. A damage of the paper web 16 as a result of too much radiant heat can thereby be avoided. The shielding advantageously occurs with the aid of what are known as blinds that can have multiple plates connected with one another, similar to a rolling shutter. Suitable arrangements for shielding the paper web 16 before the fixing process during the pre-heating of the heating elements 18, 20 as well as after the fixing process are known from the documents DE 198 27 210 C1 and DE 103 38 516 B3, for example. The designs of the embodiments described there for shielding the paper web 16 from the heat radiators 18, 20, as well as the design and the embodiments of the fixer units described there, are herewith incorporated by reference into the present specification.

The heat radiator 18 generates radiant heat to fix toner images on the front side of the paper web 16, and the heat radiator 20 generates radiant heat to fix toner images on the back side. An intervening space is respectively provided between the heat radiators 18, 20 and the paper web 16. The fixer unit 14 also has exhaust channels 22, 24 that are connected with an exhaust system. Air and possibly dust particles are drawn from the fixer region of the fixer unit 14 via the exhaust channels 22, 24. In particular, a cooling of the heating elements 18, 20 thereby occurs after a fixing process, whereby a heat accumulation in the fixer unit 14 is avoided.

Partition flaps 26*a*, 26*b* are also arranged before the fixer region and partition flaps 28*a*, 28*b* are arranged after the fixer region, via which the fixer region can be hermetically sealed.

Furthermore, two photoelectric sensors 30, 32 are provided, of which only the sensor 30 is visible in FIG. 1. A spatial region of the display unit 14 is monitored with the aid of the photoelectric sensors 30, 32, wherein the photoelectric sensors 30, 32 detect the radiation radiated by this region of a spectral range limited by an optical filter. This spectral range is advantageously the spectral range of visible light, whereby the light radiation generated by a flame burning paper or other substrate material is detected. With the aid of the filter it can be effectively prevented that the infrared radiation emitted by the heat radiators 18, 20 arrives at the photoelectric sensors 30, 32 and complicates the evaluation of the measurement result.

In the present exemplary embodiment the photoelectric sensor 30, 32 is formed by a photodiode and an evaluation circuit. The photodiode closes a measurement current loop of the evaluation circuit when the light emitted by a flame in the monitoring region strikes the detection region of the photodiode. Depending on the intensity of the emitted radiation, an input signal for a comparator of the evaluation circuit is generated with the aid of the photodiode. The comparator compares the input signal with a preset comparison value and outputs an error signal depending on the comparison result. A fire in the fixer unit 14 can in particular arise due to paper residues remaining in the fixer unit 14 and/or to an operating error or malfunction, in particular when the paper web 16 is not moved and thereby is not sufficiently shielded against the activated heat radiators 18, 20.

The photoelectric sensors 30, 32 are arranged so that their monitoring regions monitor the entire fixer region between the heat radiator 18 an the opposite paper web 16, i.e. the fixer region. The sensitivity of the photoelectric sensors 30, 32 is thereby such that an error signal is also then accurately generated when a flame occurs only at the end 18*a* of the heat radiator 18 that is arranged far from the sensor 30, 32. In the printing unit 12, a transition shaft 36 sealed off from the rest of the printing unit 12 is provided before the transition point of the paper web 16 from the printing unit 12 to the fixer unit 14, into which transition shaft 36 an already-fixed toner image is withdrawn in start-stop operation of the high-capacity printer 10 (in particular for multicolor printing or between two printing processes) in order to leave no unnecessary intervening space on the paper web 16 between two successive printing processes.

In the event of conflagration it is prevented by the shaft 36 that a fire occurring upon fixing the paper web 16 can arrive in the region of the printing groups of the printing unit 12 upon subsequent retraction of the paper web 16.

The spectral range of the radiant heat emitted by the heat radiators 18, 20 resembles that of a black box radiator and has a maximum at 2 μm to 4 μm, as is subsequently stated in further detail in connection with additional Figures. However, the proportion of the visible spectral range of the radiant heat generated by the heat radiators 18, 20 is so high that the photodiode of the sensor 30, 32 connects through, such that there can be no certain differentiation between a fire and the radiant heat. However, the spectral distribution of the flames upon combustion of substrate material lies distinctly further into the visible range. In particular, given small flames and given activated heat radiators there cannot be a certain differentiation between the error case upon occurrence of a flame and the normal state given activated heat radiators 18, 20.

Via the combination of the photodiode with a suitable optical filter, in particular with a filter glass arranged between the monitoring region and the photodiode, a certain differentiation between a flame upon combustion of the paper web 16 or of a paper residue 16*a* and the radiant heat can occur in the radiation spectrum in the visible spectral range supplied to the sensor 30, 32. Various carbon compounds are contained in typical substrate materials to be printed (such as paper and plastics). The combustion (i.e. the oxidation) of these carbon compounds with an open flame generates a radiation in the visible spectral range, in particular in the spectral range of the colors orange, yellow, green and blue. Effects of the radiation generated by the heat radiators 18, 20 are not passed through by the filter and thus do not affect the measurement result of the photoelectric sensor 30, 32. Only a radiation in a suitable spectral range that differs from the primary spectral range of the heat radiator 18, 20 is thus supplied to the sensor 30, 32. A single sensor 30, 32 is sufficient to monitor typical fixer regions of the fixer stations 14 of high-capacity printers. However, at least two sensors 30, 32 that have overlapping monitoring regions are provided in the high-capacity printer 10 according to FIG. 1. For example, the sensors 30, 32 can be arranged such that each of the sensors monitors the relevant fixer region of the fixer unit 14, wherein the error signals of the two sensors can be linked with one another via a logical AND-circuit or a logical OR-circuit. Via an AND-circuit it is achieved that both sensors 30, 32 must have detected an error (i.e. a flame), and given an OR-circuit it is sufficient that one of the sensors 30, 32 detects a flame in order to output an error signal for a combustion error. By outputting such a combustion error signal, additional actions are initiated, for example the stopping of the driving of the paper web 16 and the closing of the partition flaps 26*a*, 26*b*, 28*a*, 28*b*. The sensors 30, 32 are advantageously arranged to the right and left next to the paper web 16 in the primary transport direction of the paper web 16. The primary transport direction of the paper web 16 is indicated by the arrow P1 in FIG. 1.

Figure 2:
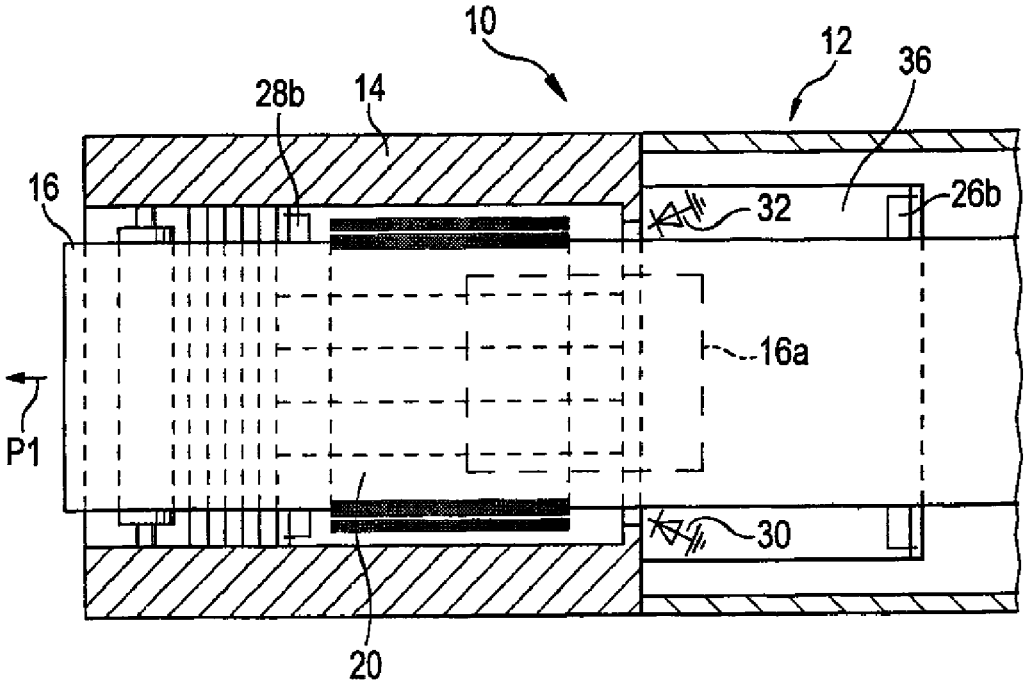
FIG. 2 is a section representation of a plan view of the portion of the high-capacity printer according to FIG. 1.

The sensors 30, 32 are thereby aligned so that—as already mentioned—the fixer region between the flat heating element 18 and the opposite region of the paper web 16 is advantageously completely monitored. In the shown exemplary embodiment, the sensors 30, 32 are arranged above the paper web 16. In other exemplary embodiments, the sensors 30, 32 can also be arranged next to the paper web 16 or below the paper web 16. The advantage of using photoelectric sensors 30, 32 that are arranged in the immediate proximity of the paper web 16 or of the substrate material to monitor the fixer region is that fires can be detected immediately after their creation. Relative to smoke sensors, this advantage given such a photoelectric sensor 30, 32 is produced in that not smoke does not first need to penetrate into a detection region of a smoke sensor in order to detect the fire; rather, the radiation arrives at the photoelectric sensor 30, 32 at the speed of light. In particular given arrangement of a smoke sensor in an exhaust flow of the exhaust drawn off via the suction nozzles 22, 24, a time advantage of multiple seconds can be achieved in the fire detection with the photoelectric sensor 30, 32 in the high-capacity printer 10. Also, in contrast to smoke sensors, no error signal will be output by the photoelectric sensors 30, 32 if the dust particle density in the fixer unit 14 or in the exhaust flow is exceeded. A section representation of a plan view of the high-capacity printer 10 according to FIG. 1 is shown in FIG. 2. Elements with the same or similar function have the same reference character.

Figure 3:
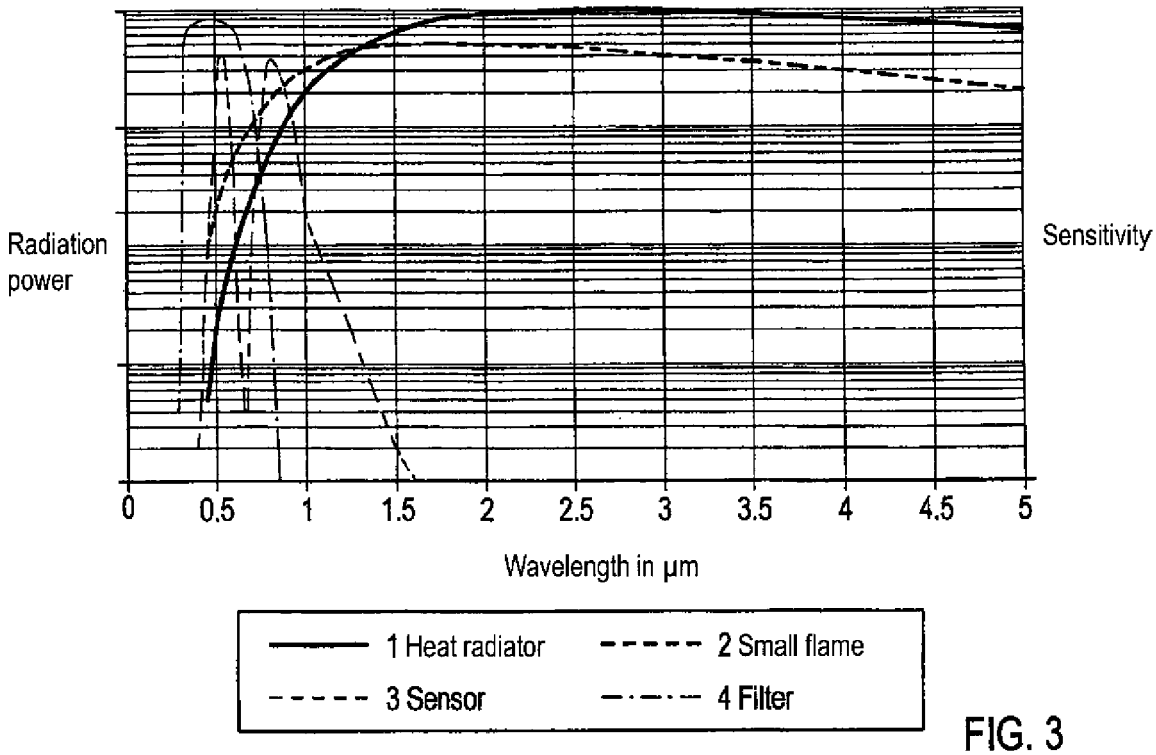
FIG. 3 is a diagram in which a radiation power of the heat radiator and a flame, a transmission range of the optical filter, and a sensitivity of the photoelectric sensor depending on the wavelength are presented.

Presented in FIG. 3 is a diagram that shows the spectral distribution of the radiation power of the heat radiator 18, the spectral distribution of a small flame of the burning paper residue 16*a*, the spectral transmission range of the filter upstream of the sensor 30, 32, and the spectral sensitivity of the sensor 30, 32. The spectral distribution of the radiant heat of the heat radiator 18 is represented in FIG. 3 by a thick solid line, the spectral distribution of a small flame by a thick dashed line, the spectral sensitivity of the sensor 30, 32 by a thin dashed line and the transmission range of the filter by a thin dash-dot line. The radiation powers of the heat radiator 18 and of the small flame as well as the sensitivity of the sensor 30, 32 and of the filter are sub-divided logarithmically in the diagram according to FIG. 3.

Figure 4:
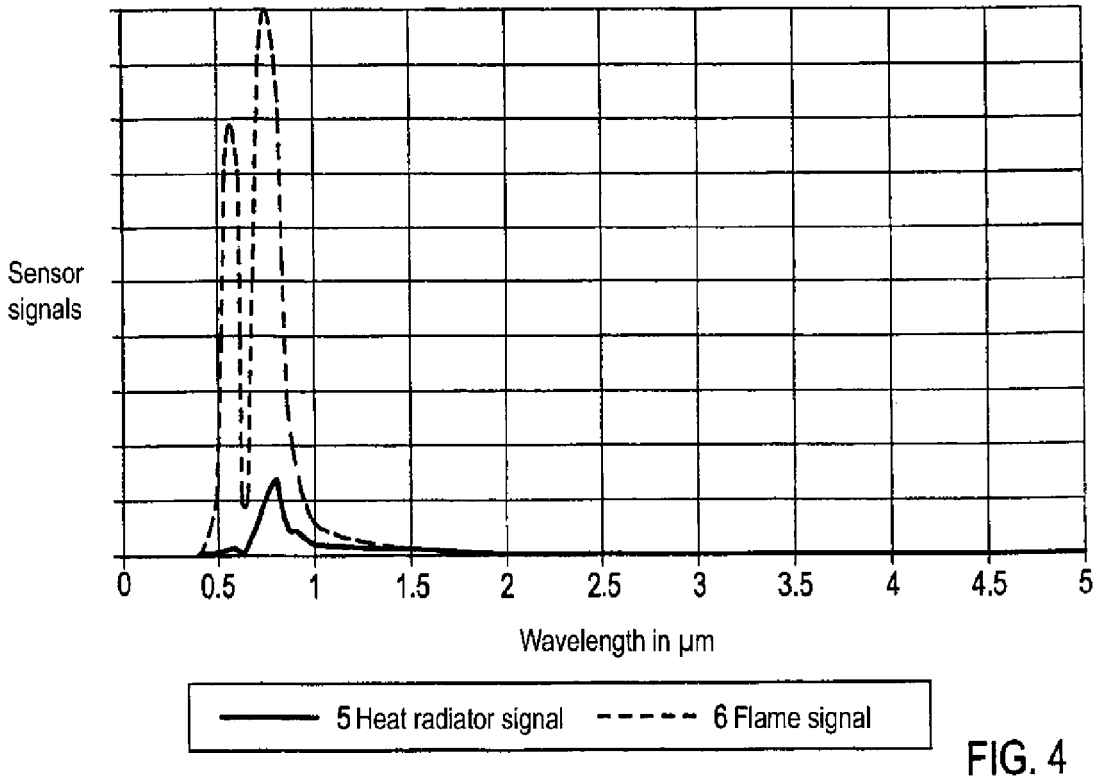
FIG. 4 is a diagram in which the sensor signals of the photoelectric sensor that are produced by the heat radiation of the heat radiator and by the radiation emitted from a flame are presented.

The response behavior of the entire arrangement of barrier filter 40 and sensor 30, 32 in the operation of the heat radiator 18 is represented in FIG. 4 as a solid line, and as a dashed line depending on the wavelength given occurrence of a flame in the fixer region of the fixer unit 14. The output voltage of the sensor 30, 32 is thereby proportional to the integral of the wavelength.

Figure 5:
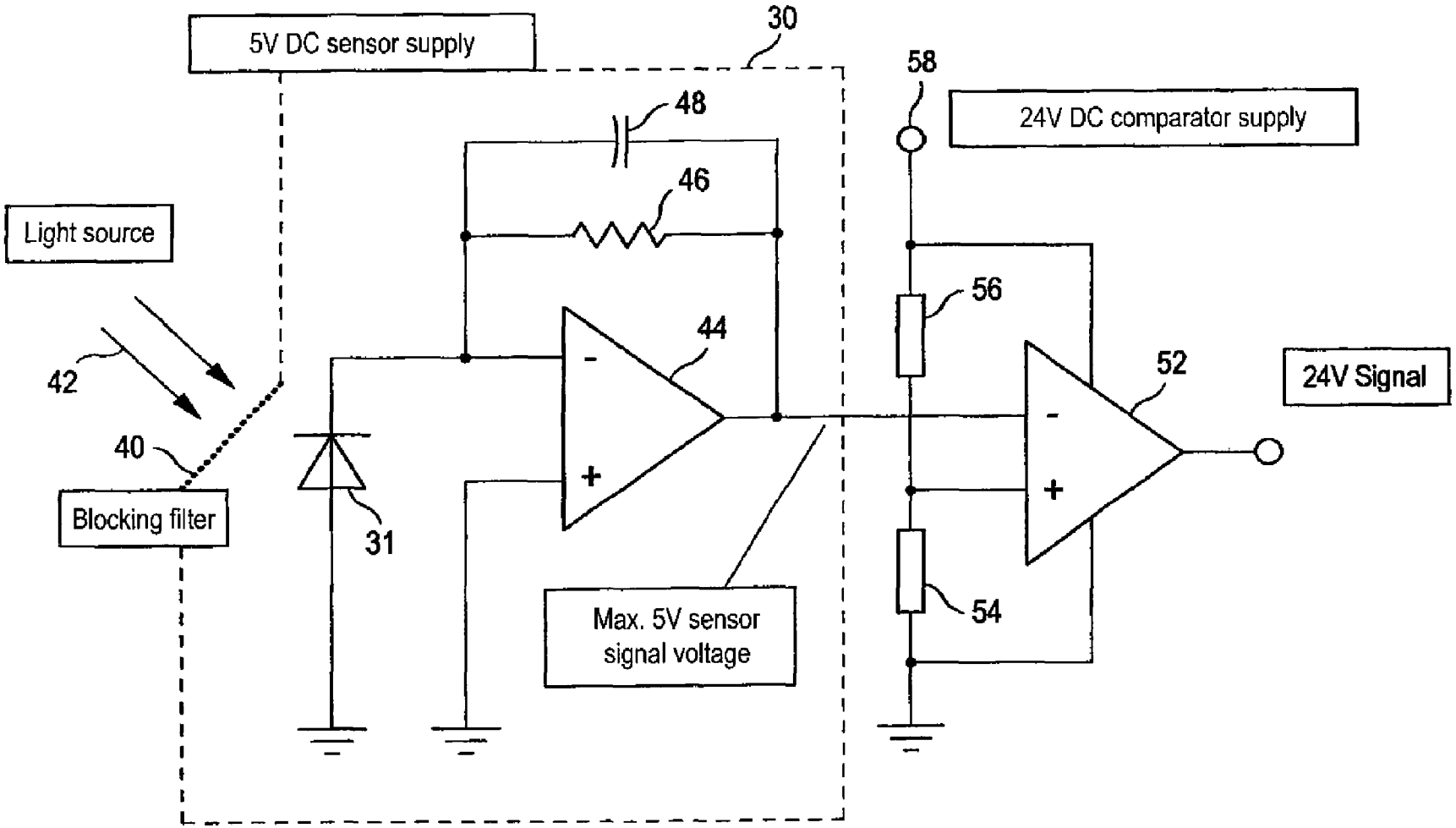
FIG. 5 is an evaluation circuit for evaluation of the sensor signal of the photoelectric sensor to generate an error signal.

An evaluation circuit to evaluate the measurement signal of the photoelectric sensor 30 formed by the photodiode and an integrated trans-impedance amplifier is presented in FIG. 5. In FIG. 5 the photodiode is designated with the reference character 31. The trans-impedance amplifier has an operation amplifier 44 and a circuit formed from the structural elements 46, 48.

The radiation 42 generated by the flame and/or the heat radiator 18 strikes a blocking filter 40 that is arranged in front of the detection region of the photodiode 31. As already explained, the blocking filter 40 can let only a selected wavelength band of the radiation 42 emitted by the heat radiator 18 and/or the flame pass to the detection region of the photodiode 32. Depending on the intensity of the radiation 42 that strikes the detection region of the photodiode 31, a proportional voltage is output at the output of the sensor 31. A logical signal with a signal level of 24 V DC is generated as an error signal and output by the evaluation circuit according to FIG. 5 via a typical comparator circuit with an operation amplifier 52 and a voltage splitter made up of two resistors 56 and 54. The response threshold of the error signal (and thus a limit value) is set via the ratio of the resistors 54, 56. The error signal output by the evaluation circuit according to FIG. 5 can subsequently be processed further in a suitable manner.

The evaluation circuit shown in FIG. 5 can be used for the sensor 32 in the same manner as explained for the sensor 30.

Figure 6:
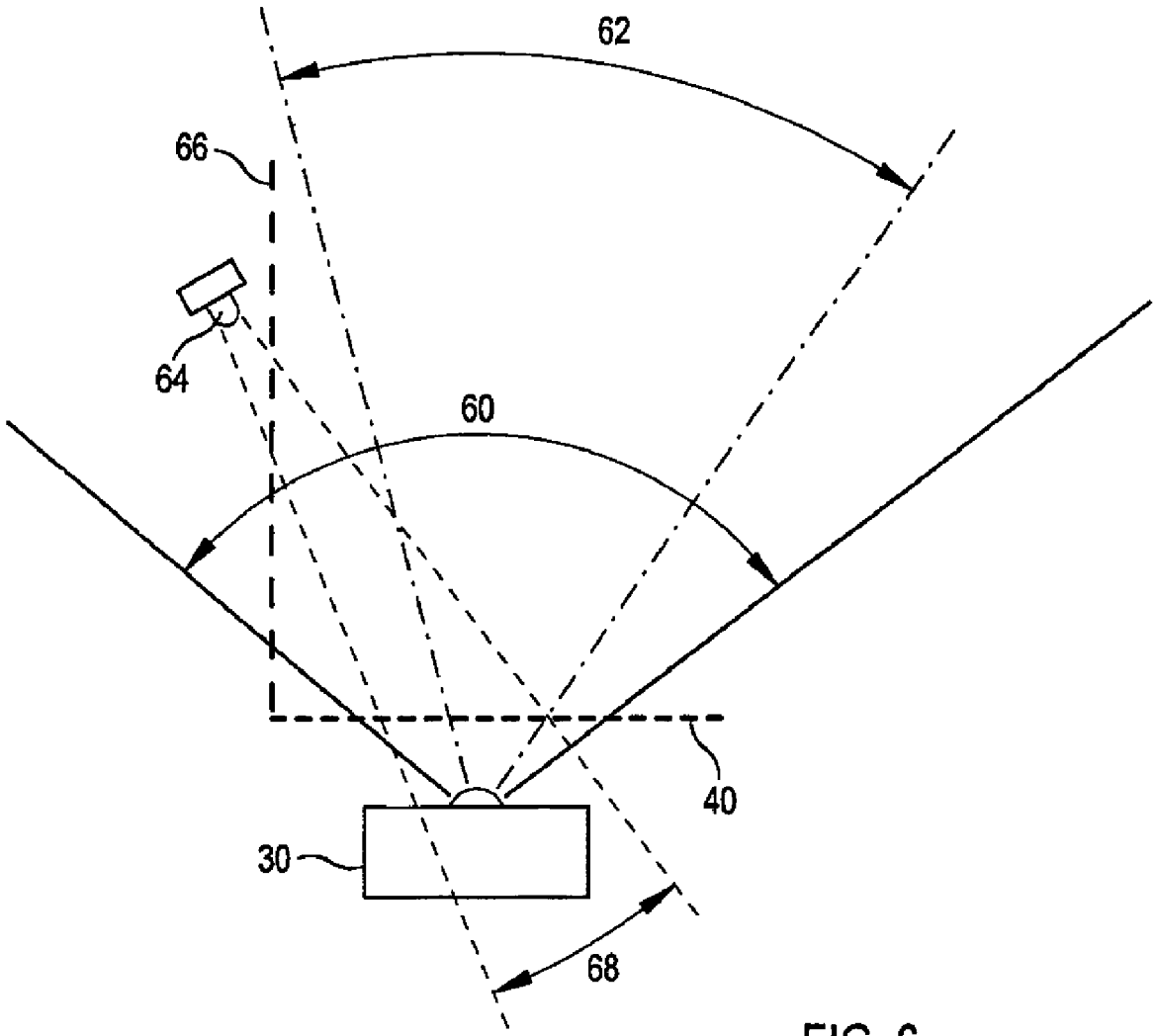
FIG. 6 is a schematic representation of the arrangement of the photoelectric sensor and a test arrangement to test the photoelectric sensor in a fixer unit of the high-capacity printer.

A test arrangement to test the function of the sensor 30 is schematically shown in FIG. 6, in which test arrangement are shown the sensor 30, the detection region 60 of the sensor 30, the monitoring region 62 of the sensor 30, a blocking filter 40 as well as a light source 64. A protective glass plate 66 is provided between the light source 64 and the monitoring region 62. A light beam 68 is emitted by the light source 64, which light beam 68 is aligned so that it passes through the filter 40 to strike a sensor region of the sensor 30.

The radiation emitted by the light source 64 thereby has such a spectral distribution and such an intensity that the evaluation circuit according to FIG. 5 outputs an error signal. Via activation of the light source 64 it can thus be checked whether the sensor 30 outputs an error signal given an activated light source 64. If that is the case, the sensor 30 is functional and also outputs an error signal upon occurrence of a fire in the fixer unit 14. With a suitable activation of the light source 64 and a suitable evaluation circuit of the sensor signal of the photoelectric sensor 30, the function of the sensor 30 can be monitored continuously even during a printing process or during a fixing process without an incorrect fire alarm occurring. This is subsequently explained in further detail in connection with FIGS. 7 through 9.

Figure 7:
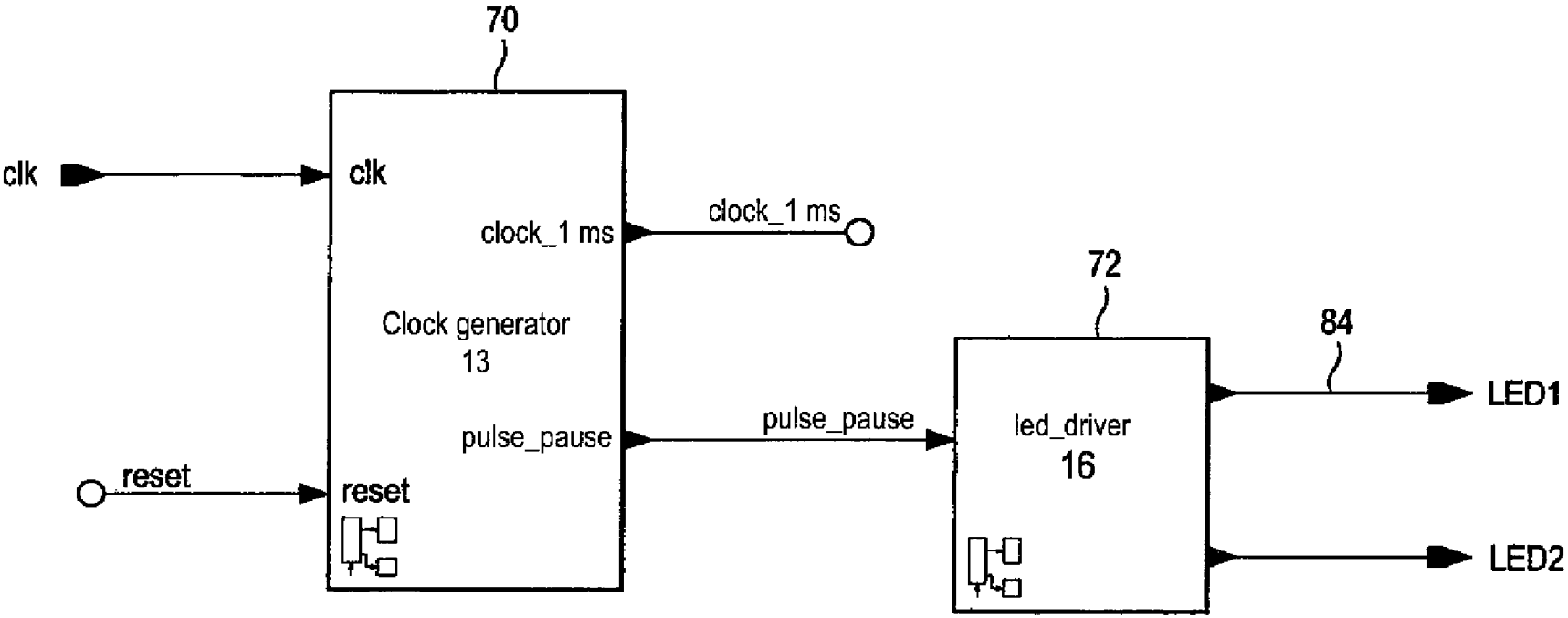
FIG. 7 is an activation circuit to control a light source of the test S arrangement according to FIG. 6.

FIG. 7 shows a control circuit to control the light source 64. The light source 64 comprises at least one light-emitting diode LED1, LED2 as a light source. A square wave signal that is supplied to an LED driver circuit 72 is generated in a pulse-pause manner with the aid of a clock generator 70 to which is supplied a clock pulse of a central clock emitter. The LED driver circuit 72 controls a first light-emitting diode LED1 and a second light-emitting diode LED2 depending on a pulse-pause signal. The first light-emitting diode LED1 serves as a test light source for the photoelectric sensor 30, and the light-emitting diode LED2 serves as a light source for the photoelectric sensor 32. The pulse-pause signal generated by the clock generator 70 causes a deactivation of the light-emitting diodes LED1, LED2 when a logical high signal is supplied via the signal line in a pulse-pause manner to the LED driver circuit 72. The clock generator 70 also outputs a pulsing clock signal with a period of one millisecond.

Figure 8:
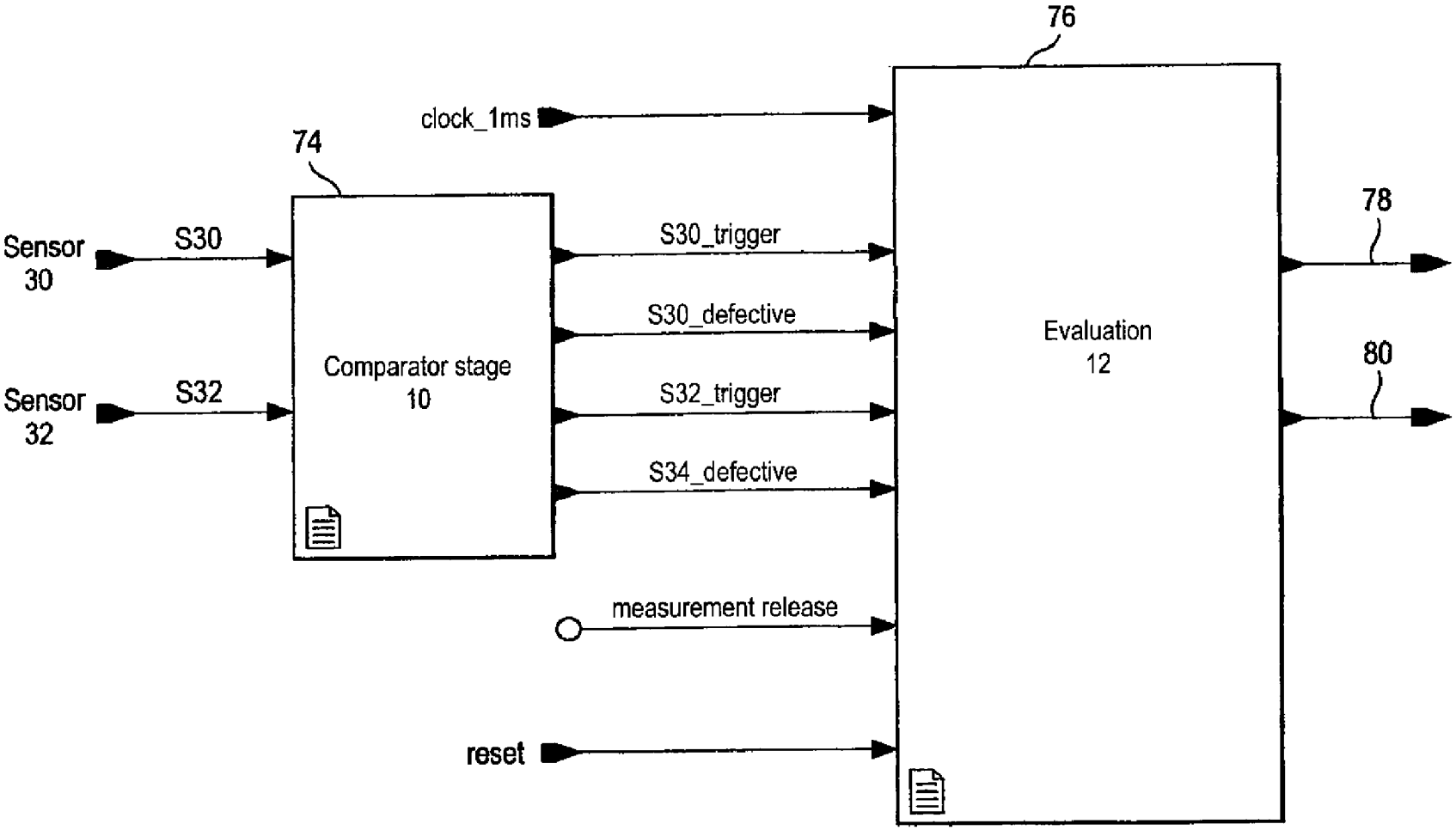
FIG. 8 is a schematic representation of an evaluation circuit to evaluate the sensor signal of the photoelectric sensor.

In FIG. 8 the sensor signals of the photoelectric sensors 30, 32 are supplied to a comparator stage 74 that compares the sensor signals with two respective, present limit values. If a first limit value is non-transiently exceeded, a fire exists, wherein a first error is supplied to an evaluation circuit 76. The evaluation circuit 76 also supplies the clock signal generated by the clock generator 70. If a second limit value is not exceeded by the respective sensor signal, a second error signal is supplied to the evaluation circuit 76. The first and second error signals are respectively generated by the comparator stage 74 for the first sensor 30 and the second sensor 32. The error signals generated by the comparator stage 74 that pertain to the first sensor 30 are designated with S30, and those that pertain to the second sensor 32 are designated with S32. The evaluation circuit 76 evaluates the supplied error signals, wherein the evaluation circuit 76 is additionally supplied with a measurement release signal. Depending on this measurement release signal, given an occurring first or second error of the first sensor 30 or given occurrence of a first or second error of the second sensor 32 a first error signal 78 is output that indicates that a conflagration or a fire has broken out in the fixer unit 14 and/or a second error signal 80 is output that indicates that a sensor error of at least one sensor 30, 32 exists.

Figure 9:
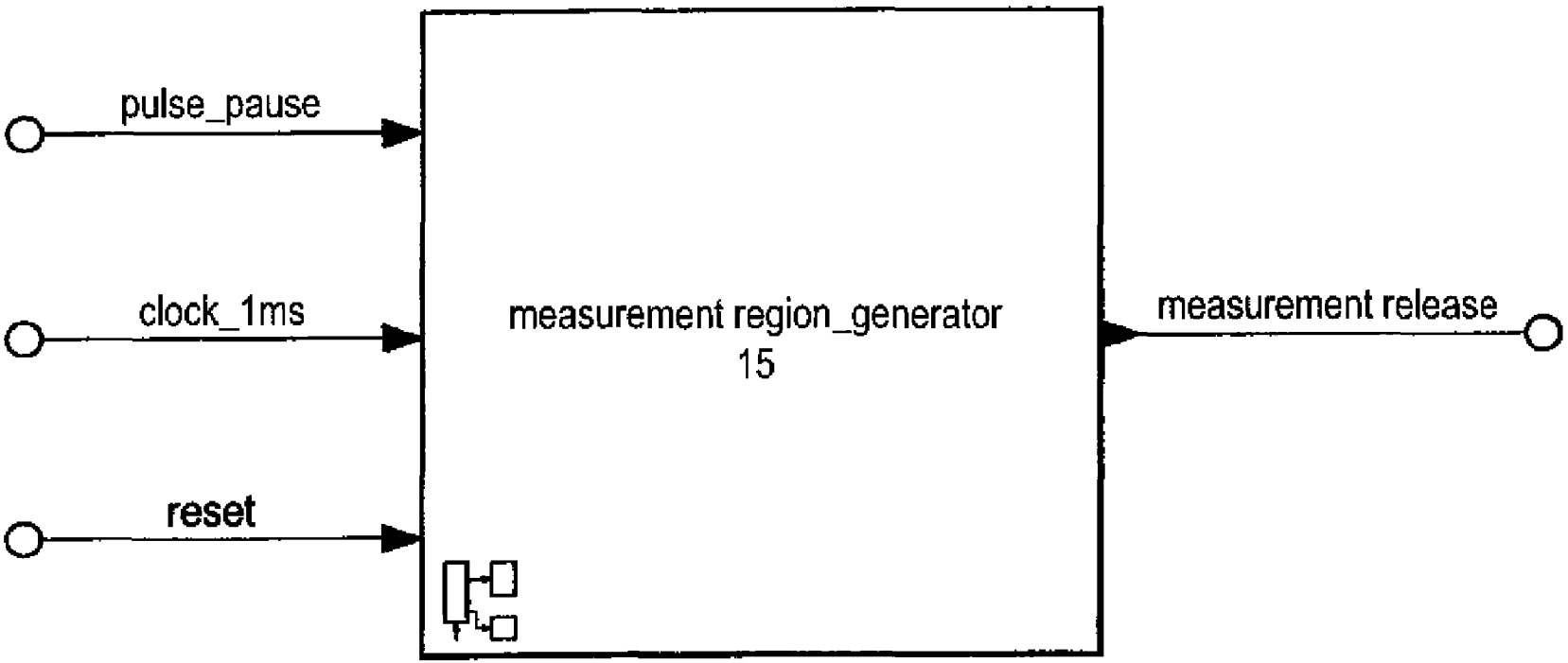
FIG. 9 is a schematic representation of a circuit to generate a measurement release signal.

A generator circuit 82 to generate the measurement release signal is shown in FIG. 9. The clock signal generated by the clock generator 70 as well as the pulse-pause signal generated by the clock generator 70 are supplied to the generator circuit 82. The generator circuit 82 generates only one measurement release signal when the light-emitting diodes LED1, LED2 are activated based on the pulse-pause signal so that they emit no light. The pulse-pause signal and the measurement release signal are generated in a clock-dependent manner. An evaluation by the evaluation circuit 76 of the first error signals supplied to the comparator stage 74 and/or a relaying of an error signal 78 thus only occurs when the evaluation is released by the measurement release signal, i.e. when the light-emitting diodes LED1, LED2 emit no light radiation.

The evaluation circuit 76 can take into account additional evaluation rules. In particular, the evaluation circuit 76 can link the first error signal of the first sensor 30 and the first error signal of the second sensor 32 with one another in a suitable manner, in particular via a logical AND-link. It is thereby ensured that a conflagration is only relayed as an error signal 78 when both sensors 30, 34 have detected the fire. It is thereby ensured that both sensors 30, 32 must have detected the fire before additional measures are taken.

The first error signal of the first sensor 30 and the first error signal of the second sensor 32 are typically linked with one another via a logical OR-link so that the error signal 78 is already output and relayed even when only one sensor 30, 32 detects the fire.

Figure 10:
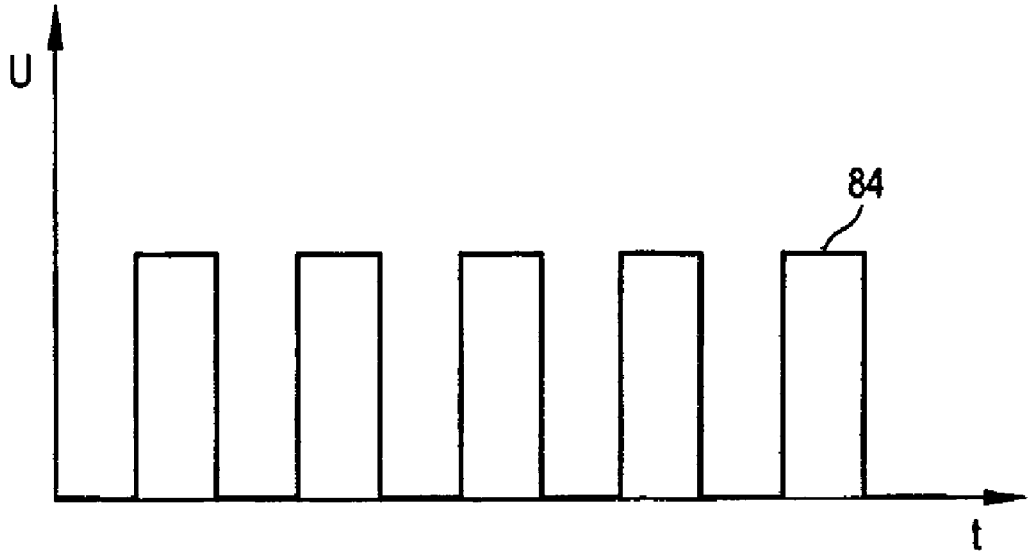
FIG. 10 is a diagram that shows the curve of the activation signal to control the light source of the test arrangement.

The spectral distribution of the light sources 64 formed by the light-emitting diodes LED1, LED2 is matched to the filter characteristic of the filter 40 and the spectral sensitivity of the photodiode 32. With the aid of the pulse-pause signal generated by the clock generator 70, the light-emitting diodes LED1, LED2 are controlled in a clocked manner with a square wave signal of constant frequency. A proportional voltage appears at the output of the respective sensor 30, 32. Every type of known measurement circuits can thereby be used for generation of the output voltage of the sensors 30, 32. A signal curve 84 to control the light-emitting diodes LED1, LED2 that respectively form a test light source 64 to test the sensors 30, 32 is shown by way of example in FIG. 10.

Figure 11:
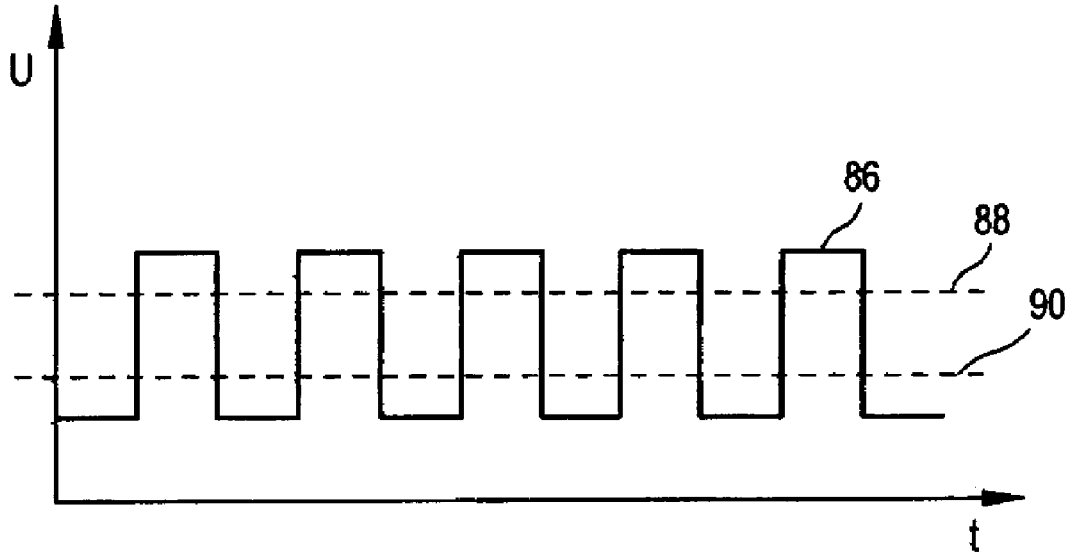
FIG. 11 is a diagram that shows the curve of the sensor signal generated by the photoelectric sensor as well as two limit values.

The signal curve of the output voltage 86 of the sensor 30 is shown in FIG. 11. Due to the clocked light-emitting diodes LED1, LED2 controlled with a square wave signal of constant frequency, the sensors 30, 32 generate a square wave sensor signal 86 corresponding to the control clock of the light-emitting diodes LED1, LED2 and output this. This output signal 86 is in particular affected by a contamination of the filter 40 and the protective glass 66.

In addition to the output signal 86, a first limit value 88 that forms a trigger threshold to trigger a fire error and a second limit value 90 that forms a defect threshold to determine a sensor error are shown. As long as the sensor signal 86 exceeds the second limit value 90 with each rectangular pulse (as shown in FIG. 11), no sensor error exists. If the sensor signal 86 falls below the first limit value 88 in each rectangular pulse, no fire is detected in the fixer unit 14.

Figure 12:
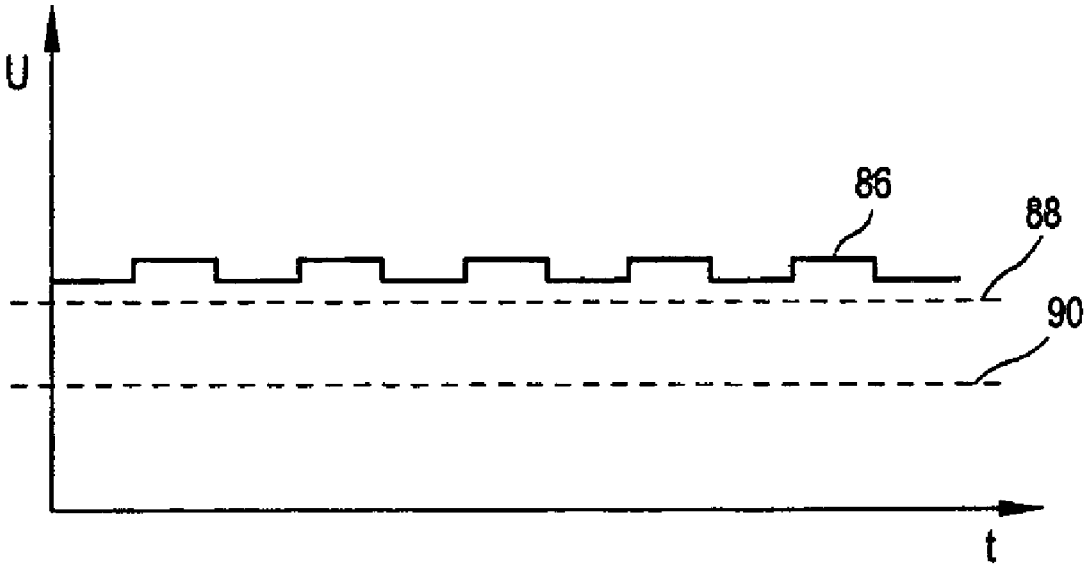
FIG. 12 is a diagram that shows the curve of the sensor signal generated by the photoelectric sensor given a conflagration.

In FIG. 12 the sensor signal 68 as well as the limit values 88 and 90 are shown. The sensor signal 86 non-transiently lies above the first limit value 88, such that a fire in the fixer unit 14 is detected. Given the signal curve of the sensor signal 86 according to FIG. 12, a fire alarm is thus triggered with the aid of the error signal 78 and counter-measures as well as protective measures can be taken immediately.

Figure 13:
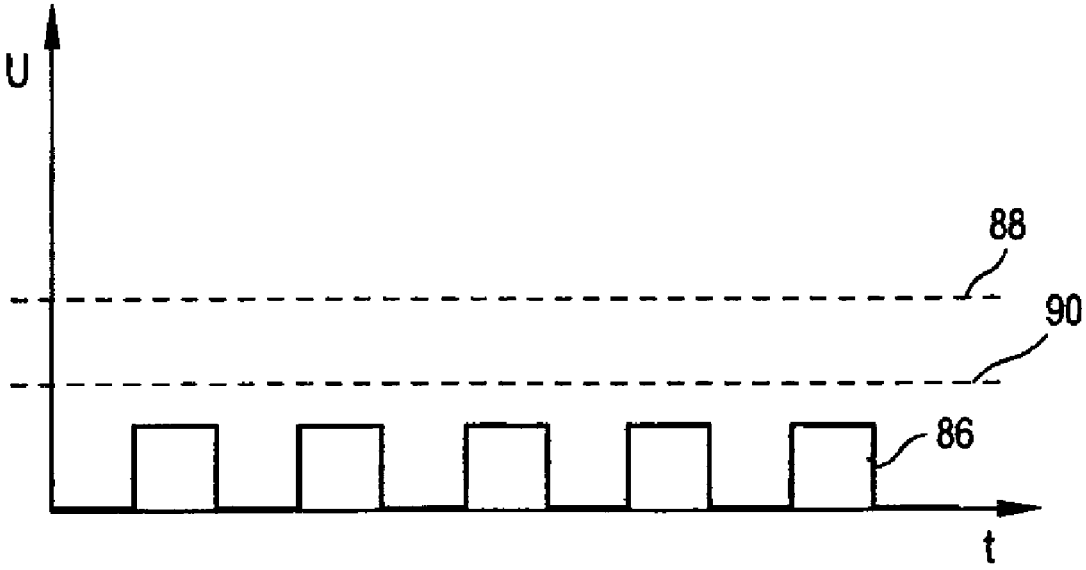
FIG. 13 is a diagram that shows the curve of the sensor signal generated by the photoelectric sensor given a sensor error due to a severely contaminated filter.

The sensor signal 86 as well as the first limit value 88 and the second limit value 90 are presented in FIG. 13, wherein the signal curve of the sensor signal 86 non-transiently falls below the second limit value 90 so that the defect threshold is non-transiently under-run and a sensor error is detected and the error signal 80 is output. In contrast to the shown limit values 88, 90, in other exemplary embodiments the first limit value 88 can also be equal to the second limit value 90, or the second limit value 90 can lie above the first limit value 88. The evaluation of the sensor signal 86 advantageously occurs with the aid of the circuits shown in FIGS. 8 and 9; the one comparator circuit as well as advantageously a filter contained in the evaluation circuit 76 are evaluated. An evaluation gap for evaluation of the signal 86 is generated with the aid of the generated measurement release signal, via which a discharge response of the evaluation circuit (in particular of the external circuit 48, 46 of the comparator 44 or the discharge response of similar measurement circuits is filtered out.

The circuits shown in FIGS. 7 through 9 are designed so that two light sources LED1, LED2 are activated and the signals of two sensors 30, 32 are evaluated. The decision matrix to generate the error signals 78, 80 to be output is advantageously generated in a programmable logic module by means of a high-level language, in particular with the aid of VHDL.

Figure 14:
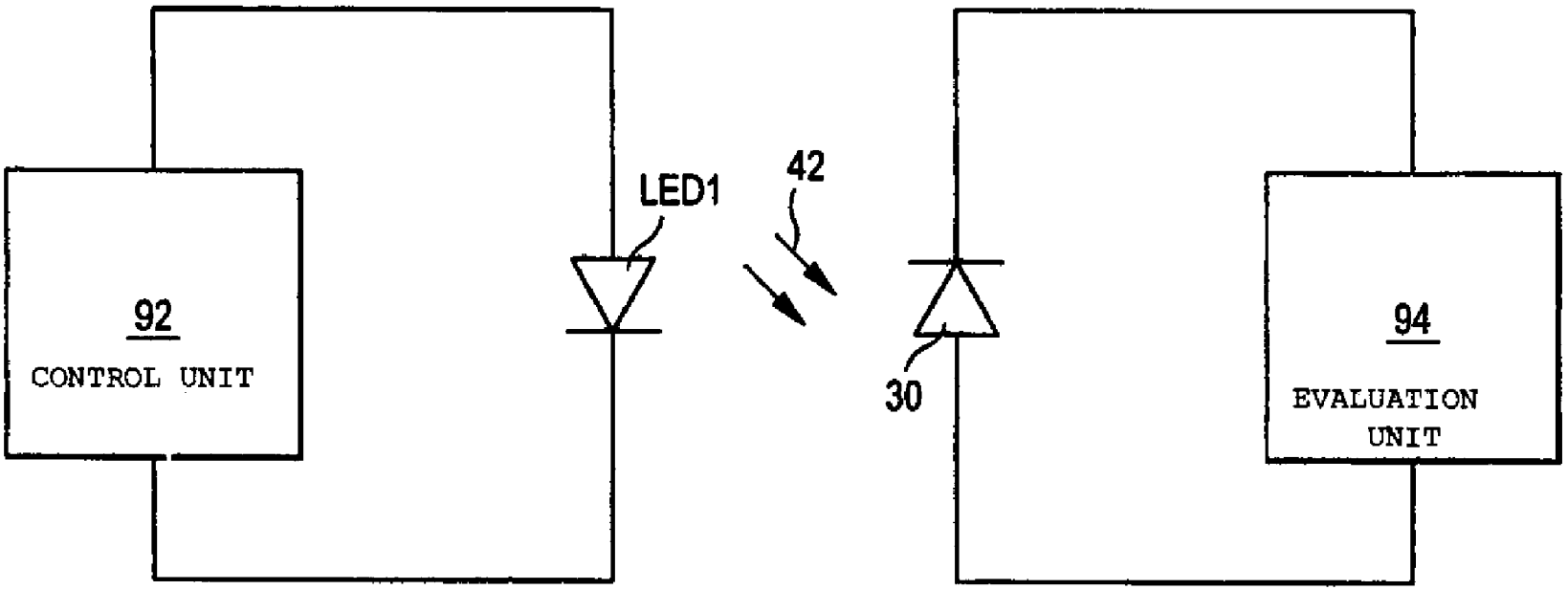
FIG. 14 is a block diagram that shows the activation of the light source of the test arrangement, as well as the evaluation unit to evaluate the sensor signals of the photoelectric sensor.

A block diagram that shows the activation of the light source 44 of the test arrangement as well as the evaluation unit to evaluate the sensor signal of the photoelectric sensor 30, 32 is presented in FIG. 14. The light-emitting diode LED1 is activated with the aid of the control unit 92. The control unit 92 in particular comprises the clock generator 70 and the LED driver 72 according to FIG. 7. With the aid of the control unit 92, the light-emitting diode LED1 is (as already described previously) controlled with a square wave signal so that it radiates light periodically for a predetermined time corresponding to this activation signal, which light strikes the sensor region of the photodiode forming the sensor 30 as radiation 42. The photodiode is connected with an evaluation unit 94 that in particular comprises a comparator and an evaluation circuit, similar to the comparator 74 and the evaluation circuit 76 according to FIG. 8. The evaluation unit 94 evaluates the sensor signal of the sensor 30 and outputs a first error signal upon detection of a conflagration in the fixer unit 14 and outputs a second error signal given the presence of a sensor error.

The sensors 30, 32 can be arranged inside the fixer station itself and/or in a region adjoining the fixer unit 14 (for example a printing unit) so that their respective monitoring region covers at least a portion of the fixer region.

The error signal output by the sensor 30, 32 must advantageously be detected interrupted over a preset time period (for example a length of a preset number of clock pulses) before an error signal 78 is output via which additional techniques are taken. These additional techniques can also comprise the introduction of fire-suppressing materials (for example $CO_2$) into the fixer region.

Although a preferred exemplary embodiment has been indicated and described in detail in the preceding specification, it should be viewed as purely exemplary and not as limiting the invention. It is noted that only the preferred exemplary embodiment is presented and described, and all variations and modifications that presently and in the future lie within the scope of the invention should be protected.

We claim as our invention:

1. A fixer unit system for an electrographic image generation device, comprising:

a fire detector to detect a fire in a fixer unit of the fixer unit system;

at least one heat radiator in the fixer unit to fix a toner image to be fixed onto a substrate material;

said fire detector comprising a photoelectric sensor arranged at or near the fixer unit adjacent the substrate material having the toner image to be fixed;

the photoelectric sensor being arranged or designed such that it does not detect at least a portion of radiation generated by the at least one heat radiator wherein an optical filter is provided for the photoelectric sensor that does not let said at least a portion of the radiation generated by the at least one heat radiator to pass to the photoelectric sensor;

the fixer unit having at least one heat radiator arranged opposite the front side or the back side of the substrate material, such that at least one toner image on the front side or the back side of the substrate material is fixed on the substrate material with aid of the radiant heat generated by the heat radiator upon directing the substrate material past the heat radiator; and an intervening space provided between the heat radiator and the substrate material, and wherein the at least one photoelectric sensor monitors at least one region of the intervening space.

2. A fixer unit system according to claim 1 wherein the photoelectric sensor comprises a photodiode, a phototransistor or a solar cell.

3. A fixer unit system according to claim 1 wherein the optical filter passes light in a visible spectral range to the photoelectric sensor.

4. A fixer system according to claim 1 wherein the filter does not pass a portion of the radiation generated by the heat radiator, wherein the filter does not pass radiation in the infrared or ultraviolet spectral range, and wherein the filter is integrated into the photoelectric sensor or is arranged as a separate optical component in front of the photoelectric sensor.

5. A fixer unit system for an electrographic image generation device, comprising:

a fire detector to detect a fire in a fixer unit of the fixer unit system;

at least one heat radiator in the fixer unit to fix a toner image to be fixed onto a substrate material;

said fire detector comprising a photoelectric sensor arranged at or near the fixer unit adjacent the substrate material having the toner image to be fixed;

the photoelectric sensor being arranged or designed such that it does not detect at least a portion of radiation generated by the at least one heat radiator wherein an optical filter is provided for the photoelectric sensor that does not let said at least a portion of the radiation generated by the at least one heat radiator to pass to the photoelectric sensor; and at least one partition arrangement that seals off a fixer region of the fixer unit depending on an error signal generated by the photoelectric sensor upon occurrence of a conflagration in the fixer unit or an error signal generated by an evaluation unit connected with the photoelectric sensor, such that no fire can leave the fixer region.

6. A fixer unit system according to claim 5 wherein at least one first partition arrangement is arranged before the fixer region and at least one second partition arrangement is arranged after the fixer region.

7. A fixer unit system according to claim 6 wherein at least one regulator element is provided to activate the partition arrangement.

8. A fixer unit system for an electrographic image generation device, comprising:

a fire detector to detect a fire in a fixer unit of the fixer unit system;

at least one heat radiator in the fixer unit to fix a toner image to be fixed onto a substrate material;

said fire detector comprising a photoelectric sensor arranged at or near the fixer unit adjacent the substrate material having the toner image to be fixed;

the photoelectric sensor being arranged or designed such that it does not detect at least a portion of radiation generated by the at least one heat radiator wherein an optical filter is provided for the photoelectric sensor that does not let said at least a portion of the radiation generated by the at least one heat radiator to pass to the photoelectric sensor; and a monitoring unit to monitor a function of the photoelectric sensor that has a light source and an evaluation unit, wherein the light source emits light via which the photoelectric sensor generates an error signal, wherein the evaluation circuit monitors an error signal caused by the light emitted by the light source.

9. A fixer unit system according to claim 8 wherein the evaluation unit determines a sensor error given absence or under-run of an error signal expected due to the emitted light, wherein the evaluation unit outputs a first error signal given an error signal produced by a conflagration and a second error signal given a sensor error.

10. A fixer unit system according to claim 9 wherein the light source is periodically activated.

11. A fixer unit system according to claim 8 wherein the evaluation unit generates the first error signal given non-transient over-run of a first limit value and the second error signal given an under-run of a second limit value given an activated light source.

12. A fixer unit system for an electrographic image generation device, comprising:

a fire detector to detect a fire in a fixer unit of the fixer unit system;

at least one heat radiator in the fixer unit to fix a toner image to be fixed onto a substrate material;

said fire detector comprising a photoelectric sensor arranged in a transition shaft at an input of the fixer unit; and the photoelectric sensor being arranged or designed such that it does not detect at least a portion of radiation generated by the at least one heat radiator wherein an optical filter is provided for the photoelectric sensor that does not let said at least one portion of the radiation generated by the at least one heat radiator to pass to the photoelectric sensor.

* * * * *